US008105041B2

(12) United States Patent
Brillert et al.

(10) Patent No.: US 8,105,041 B2
(45) Date of Patent: Jan. 31, 2012

(54) ARRANGEMENT FOR AXIALLY SECURING ROTATING BLADES IN A ROTOR, SEALING ELEMENT FOR SUCH AN ARRANGEMENT, AND USE OF SUCH AN ARRANGEMENT

(75) Inventors: Dieter Brillert, Rodgau (DE); Harald Hoell, Wächtersbach (DE); Armin Hülfenhaus, Langenfeld (DE); Claus Vögelin, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 680 days.

(21) Appl. No.: 11/991,439

(22) PCT Filed: Aug. 21, 2006

(86) PCT No.: PCT/EP2006/065512

§ 371 (c)(1),
(2), (4) Date: Jan. 22, 2009

(87) PCT Pub. No.: WO2007/028703

PCT Pub. Date: Mar. 15, 2007

(65) Prior Publication Data

US 2009/0116965 A1 May 7, 2009

(30) Foreign Application Priority Data

Sep. 7, 2005 (DE) ..... 10 2005 042 597

(51) Int. Cl.
*F01D 5/32* (2006.01)

(52) U.S. Cl. ..... 416/221; 416/220 R

(58) Field of Classification Search ..... 416/221, 416/219 R, 220 R, 220 A, 219 A, 214, 216; 415/173.7, 174.5, 174.4
See application file for complete search history.

(56) References Cited

U.S. PATENT DOCUMENTS

| | | | | |
|---|---|---|---|---|
| 2,833,515 | A * | 5/1958 | Newcomb | 416/140 |
| 2,971,744 | A * | 2/1961 | Szydlowski | 416/221 |
| 3,096,074 | A * | 7/1963 | Pratt et al. | 416/215 |
| 3,853,425 | A | 12/1974 | Scalzo et al. | |
| 4,444,544 | A * | 4/1984 | Rowley | 416/221 |
| 4,846,628 | A * | 7/1989 | Antonellis | 416/220 R |
| 5,282,720 | A * | 2/1994 | Szpunar | 416/220 R |
| 6,494,684 | B1 * | 12/2002 | Wagner | 416/248 |
| 6,561,764 | B1 * | 5/2003 | Tiemann | 416/96 R |
| 7,244,105 | B2 * | 7/2007 | Moeller | 416/220 R |
| 7,318,704 | B2 * | 1/2008 | Wagner | 416/220 R |
| 2008/0008593 | A1 * | 1/2008 | Zagar et al. | 416/220 R |
| 2008/0181767 | A1 * | 7/2008 | Brillert et al. | 415/170.1 |

FOREIGN PATENT DOCUMENTS

| | | |
|---|---|---|
| GB | 954323 | 4/1964 |
| GB | 1 209 419 | 10/1970 |
| GB | 2 043 796 A | 10/1980 |
| RU | 2238412 C1 | 10/2004 |

* cited by examiner

*Primary Examiner* — Van Nguyen
*Assistant Examiner* — Douglas King

(57) ABSTRACT

An arrangement is presented for axially securing rotating blades in a rotor, having a shaft collar on whose external circumference rotating blade securing grooves which extend in the axial direction of the rotor are provided. At one end side face of the shaft a projection is arranged in the region of the securing grooves, in which projection a circumferential groove which is open radially towards the outside is provided and said projection having securing grooves which are arranged in each rotating bade, sheet-metal-shaped sealing elements which each engage in the circumferential groove and in the securing groove and form an end side sealing ring in the circumferential direction being provided for axially securing the rotating blades, and at least one of the sealing elements comprising a sheet metal strip which is attached to said sealing ring in order to secure the sealing elements against displacement in the circumferential direction.

20 Claims, 4 Drawing Sheets

ARRANGEMENT FOR AXIALLY SECURING ROTATING BLADES IN A ROTOR, SEALING ELEMENT FOR SUCH AN ARRANGEMENT, AND USE OF SUCH AN ARRANGEMENT

CROSS REFERENCE TO RELATED APPLICATIONS

This application is the US National Stage of International Application No. PCT/EP2006/065512, filed Aug. 21, 2006 and claims the benefit thereof. The International Application claims the benefits of German application No. 10 2005 042 597.6 filed Sep. 7, 2005, both of the applications are incorporated by reference herein in their entirety.

FIELD OF INVENTION

The invention relates to an arrangement for axially securing rotating blades in a rotor, comprising a shaft collar, on whose outer circumference rotating-blade retaining slots running in the axial direction of the rotor are provided, in which rotating-blade retaining slots respective rotating blades having blade roots corresponding to the rotating-blade retaining slots are arranged, comprising a projection which is arranged on a front-end side face of the shaft collar in the region of the retaining slots and in which an encircling slot which is open radially outward is provided, wherein sheet-metal-like sealing elements engaging in each case in the encircling slot are provided for axially securing the rotating blades, said sealing elements forming a front-end sealing ring in the circumferential direction, wherein, to secure the sealing elements against a displacement in the circumferential direction, at least one of the sealing elements comprises a sheet-metal strip fastened to said sealing element. The invention also relates to the use of such an arrangement and to a sealing element having a sheet-metal strip fastened to said sealing element.

BACKGROUND OF THE INVENTION

Rotors of gas turbines are known in which turbine rotating blades arranged at the outer circumference in rotating-blade retaining slots are secured against axial displacement by means of sealing plates.

To this end, different constructions are known from the prior art. For example, GB 954,323 shows an arrangement of sealing plates of the generic type on a rotor. To secure the moving blades against an axial displacement inside their retaining slot, sealing plates are provided which are hooked both to the rotor disk and to the platform underside of the rotating blades. On account of the construction selected, a sealing plate lock is necessary, which has to be inserted last into the rotor slots in order to complete the ring of sealing plates. In this case, two sealing plate halves which are split transversely to the radial direction are provided. The two sealing plate halves and the adjacent sealing elements directly to the left and right of them are secured against detachment by means of a sheet-metal strip which can be placed against the sealing plate halves and can be secured in the sealing plate ring by two auxiliary elements.

Furthermore, GB 2 043 796 and GB 1 209 419 disclose different sealing plate fastenings which are in each case restrained with the rotor disk via a screw or bolt on said rotor disk.

In addition, FIG. 1 shows a further known fastening of sealing plates on rotor disks in plan view and FIG. 2 shows such a fastening in cross section along section line II-II in FIG. 1. Two adjacent sealing plates 16 are provided for each rotating blade 14 to be secured against an axial displacement inside its rotating-blade retaining slot 12, said sealing plates 16 each covering half the front-end opening of the rotating-blade retaining slot 12. Each sealing plate 16 is inserted at its radially inner end 18 in a slot 20 provided at the front end on a rotor disk 19 and at its radially outer end 22 in a securing slot 24 which is provided on the underside 26 of a platform 28 of the rotating blade 14. In order to secure each sealing plate 16 against a displacement in the circumferential direction U, a rectilinear sheet-metal strip 30 extending essentially in the radial direction of the rotor 23 is fastened to each sealing plate 16. Each sheet-metal strip 30 ends at its radially outer end 32 in an evenly converging tip 34. There are chamfered edges 36 on the platforms 28 of the rotating blades 14, two opposite edges 36 of directly adjacent rotating blades 14 in each case forming a recess 38 which tapers to a point and into which the tip 34 of the sheet-metal strip 30 can project and come into contact for securing the sealing plates 16 against a displacement in the circumferential direction U In addition, the sealing plates 16 provide for separation of two regions 37, 39 in which cooling air can occur on the one hand and an undesirable hot-gas flow can occur on the other hand.

To fasten the sheet-metal strips 30 to the sealing plate 16, two parallel slots 40, through which the sheet-metal strip 30 already pre-bent in a U shape is inserted, are provided in said sealing plate 16. That end 41 of the sheet-metal strip 30 which is opposite the tip 34 is bent into the position shown in FIG. 2 for fastening the sheet-metal strip 30 before the sealing plate 16 is fitted on the rotor disk 19.

After the fitting of the rotating blades 14 in the rotor disks 19, the sealing plates 16 together with the pre-fitted sheet-metal strips 30 are fitted into the endlessly encircling slot 20 arranged on the rotor disk 19 and into the securing slot 24 arranged on the underside 26 of the platform 28. The sealing plates 16 are positioned along the circumference of the slot 20 in such a way that each sheet-metal strip 30 is opposite a recess 38. The tips 34 of the sheet-metal strips 30 are then bent into the recesses 38 in order to rule out the possibility of a displacement of the sealing plates 16 in the circumferential direction U.

SUMMARY OF INVENTION

An object of the present invention is to specify an alternative arrangement for securing the sealing elements against a displacement threatening to take place in the circumferential direction. A further object of the invention is to provide a sealing element which can be used for this purpose and to specify the use of such an arrangement.

The object relating to the arrangement for axially securing rotating blades in a rotor is achieved by the features of the claims.

The invention proposes that the sheet-metal strip be of essentially L-shaped design in its extent, wherein its first leg extending in the circumferential direction is fastened to the sealing element and its second leg extending inward in the radial direction engages in a securing pocket, which securing pocket is provided in the front-end region of the shaft collar. The invention thus deviates from the previous solution in which a displacement of the sealing elements in the circumferential direction is prevented by the sheet-metal strip bearing against the rotating blades, i.e. in the region of the radially outer end of the sealing element. In contrast, the invention proposes that the sheet-metal strip engage in a securing pocket which now lies radially on the inside with respect to the sealing element and is provided on the side face or front end of the shaft collar.

The invention is based on the knowledge that, if the securing pocket were to be shifted merely from radially on the outside to radially on the inside while retaining a rectilinear sheet-metal strip, the sheet-metal strip can bend up during operation of the gas turbine on account of the centrifugal force acting on it and can thus become detached from the securing pocket. In order to prevent this, the invention goes one essential step further. The sheet-metal strip is no longer of rectilinear design as hitherto, but rather has, in a plane essentially parallel to the sheet-metal-like sealing element, a shape bent at right angles like an L with two legs. A first leg, extending in the circumferential direction, of the sheet-metal strip is fastened to the sealing element, for example in a manner already known, and a second leg extending inward in the radial direction engages in the fitted position in the securing pocket provided on the side face of the shaft collar. On account of the bent section of the sheet-metal strip between the two legs rectilinear per se, bending-up of the sheet-metal strip due to centrifugal force during operation of the gas turbine is effectively and reliably prevented.

Since both the securing of the rotating blades against an axial displacement by means of the sealing element and the design principle of the hooking of the sheet-metal strip to the sealing element through two slots provided therein have proved successful, the principle has been retained in order to continue to be able to fit and remove the rotating blades. To this end, the sealing elements are to be displaced in the circumferential direction and the sheet-metal strips are to be correspondingly bent when fitting into the securing pocket or when removing from the securing pocket. Furthermore, there are no screwed connections or pin connections, which possibly have to be bored out during dismantling.

Furthermore, each sheet-metal strip bent at right angles, compared with the sheet-metal strips known from the prior art, sits at a noncritical point for the sealing elements and thus improves the buckling behavior of the sealing elements. In addition, the temperature occurring at the sealing element during operation of the gas turbine decreases with decreasing radius, a factor which can be essentially attributed to the lower intake of hot gas at this point. Since the sheet-metal strips are now provided at the inner radius, and not as hitherto at the outer radius, of the sealing element, said sheet-metal strips are also advantageously subjected to a lower temperature. This leads to increased and improved rigidity of the sheet-metal strip and to a prolonged service life. In addition, due to the bending process, i.e. when the sheet-metal strips are being bent into the securing pocket, compressive stresses are introduced at the points of the sheet-metal strip subjected to the highest load during operation of the gas turbine, and these compressive stresses are superimposed with tensile stresses during the operation of the gas turbine and therefore at least partly neutralize one another. In the prior art, tensile stresses have been superimposed here in an adverse manner.

Furthermore, once the sealing elements have been used and then removed, the construction enables said sealing elements to be used again, only the sheet-metal strips then having to be renewed.

A further advantage of the subject matter according to the invention is that each rotating blade can be secured merely by one sealing element assigned to it, such that, during an exchange of an individual rotating blade of the blade ring, only one sealing element now has to be removed and not two sealing plates as in the closest prior art. This reduces the duration of maintenance work and downtimes of the gas turbine thus equipped.

Advantageous configurations are specified in the subclaims.

It has turned out to be especially advantageous if at least every second sealing element or every sealing element has a sheet-metal strip of identical construction to the sheet-metal strip and intended for securing against its displacement in the circumferential direction. Therefore the sealing ring formed by all the sealing elements is secured against a displacement in the circumferential direction at a plurality of positions distributed over the circumference.

In a development, the side regions of the second leg of each sheet-metal strip bear against the respective side walls, extending in the radial direction, of the securing pocket, which constitutes an effective measure against a displacement of the sealing elements in the circumferential direction. It is especially advantageous if the slot encircling at the front end, in which slot the sealing elements are held radially on the inside, is arranged radially further on the inside with respect to the rotating-blade retaining slots. A cost-effective, endlessly encircling slot which is especially simple to produce can therefore be obtained during the production of the shaft collar.

According to a further configuration, the securing pocket which is provided on the end face of the shaft collar is formed by two spaced-apart teeth which are arranged at the front end and extend radially outward.

A securing slot which is arranged in each rotating blade and in which the sealing element can engage radially outward is expediently provided on an underside of a platform of the rotating blade. In this way, the sealing element is securely fixed and positioned at two radially spaced-apart points.

The shaft collar is expediently formed by a rotor disk.

In an alternative configuration, the slot encircling at the front end is arranged radially at the level of the rotating-blade retaining slots. A further slot which is open outward is provided radially further on the inside, the sealing element engaging in both slots and in addition bearing against the root of the rotating blade at the front end. In this way, reliable hooking of the sealing element at least two radially spaced-apart points is achieved, such that a force occurring in the axial direction due to the displacement of the rotating blade can be reliably compensated by the sealing element.

The object which relates to the sealing element is achieved by the features of claim 9. The advantages resulting for the sealing element correspond to the advantages of the arrangement.

The arrangement is used in an especially advantageous manner in an axial-flow, stationary gas turbine whose rotating blades arranged on the rotor are each secured against an axial displacement by sealing elements.

BRIEF DESCRIPTION OF THE DRAWINGS

The invention is explained with reference to an exemplary embodiment shown in a drawing. Further advantages and features follow from the explanation.

DETAILED DESCRIPTION OF INVENTION

Figure 1:
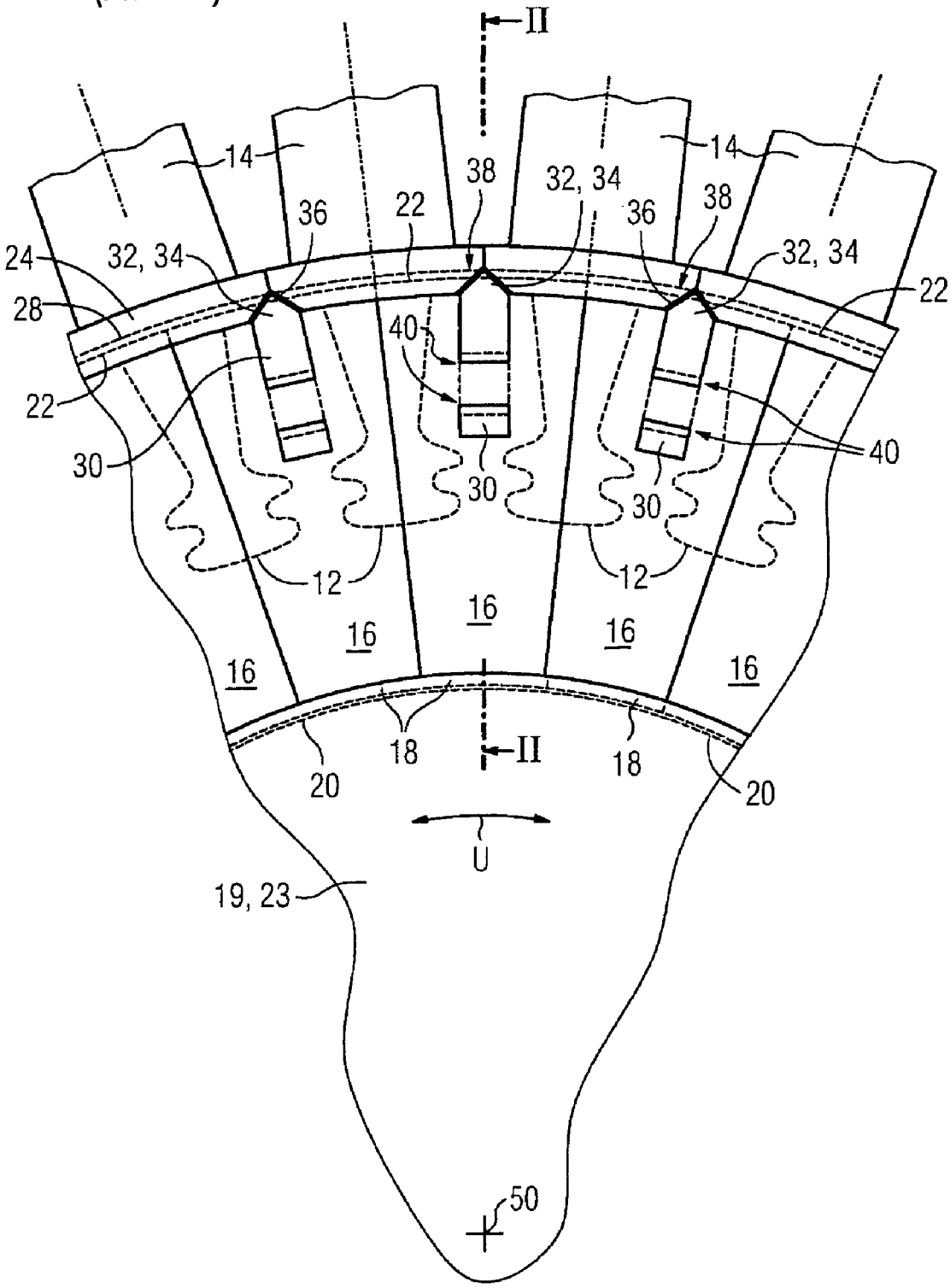
FIG 1 (Prior art)
FIG. 1 shows the arrangement for axially securing rotating blades in a rotor according to the prior art.
Figure 2:
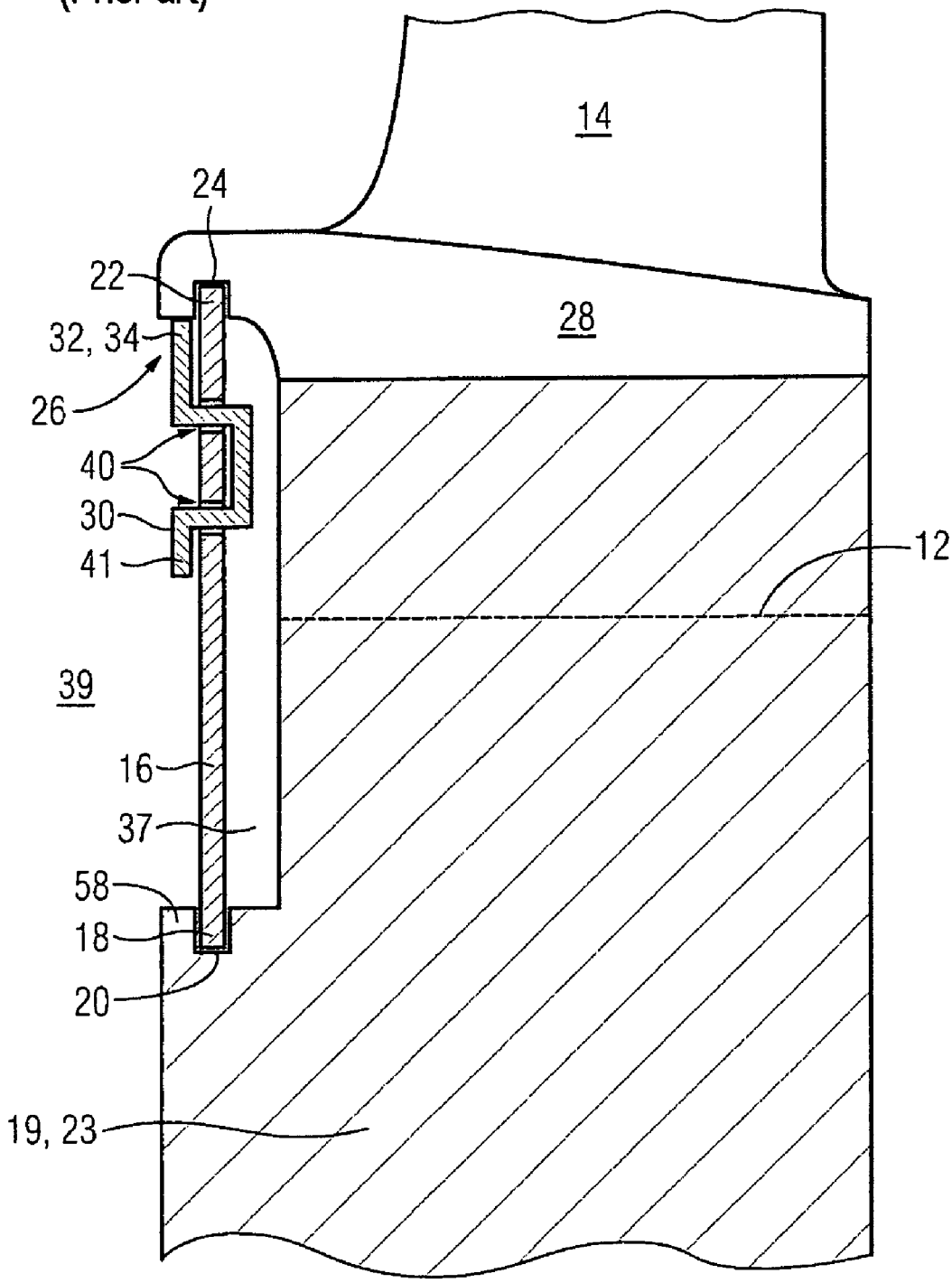
FIG 2 (Prior art)
FIG. 2 shows the cross-sectional view according to FIG. 1 along section line II-II.
Figure 3:
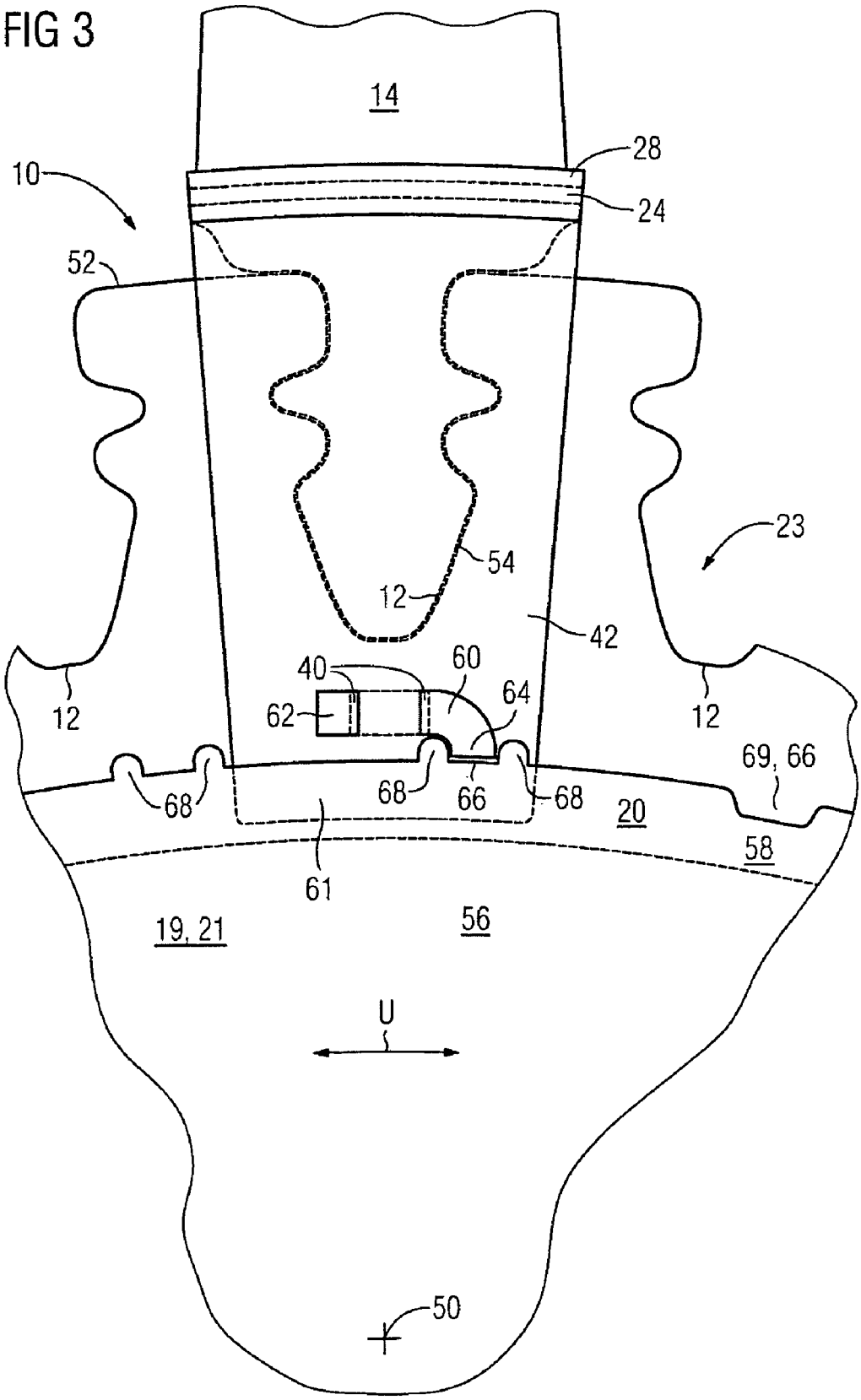
FIG. 3 shows the sealing element according to the invention in a plan view.

FIG. 3 shows a detail of the front-end plan view of the shaft collar 21, formed by a rotor disk 19, of a rotor 23 of a gas turbine. At its outer circumference 52, the rotor 23, which is rotatable about the rotation axis 50, has rotating-blade retaining slots 12 which are distributed over the circumference U and extend in the axial direction and into which a respective rotating blade 14 having a blade root 54 designed to correspond to the rotating-blade retaining slot 12 can be pushed. A rotating blade 14 is already pushed into place in the rotating-blade retaining slot 12 shown centrally in FIG. 3. As in the prior art shown in FIGS. 1 and 2, an axially extending projection 58 or widened portion having an encircling slot 20 which is open radially outward therein is arranged on a front end of the rotor disk 19 or on a front-end side face 56 of the shaft collar 21. The slot 20 is arranged, for example, radially further on the inside than the rotating-blade retaining slots 12. The rotating blade 14 has a platform 28 which is arranged between the blade root 54 and the profiled airfoil and on whose underside a securing slot 24, open toward the encircling slot 20, is provided and is at the same time located opposite the latter. In a manner analogous to the prior art, a sealing element 42 is inserted into the endlessly encircling slot 20 and into the securing slot 24, said sealing element securing the rotating blade 14 against a displacement along the rotating-blade retaining slot.

In contrast to the closest prior art, each sealing element 42, as shown in FIG. 3, completely covers the front-end opening of one of the rotating-blade retaining slots 12 and thus secures in each case the relevant rotating blade 14 against a displacement along the rotating-blade retaining slot 12.

If necessary, as in the prior art, the sealing elements 42 may also be distributed over the circumference in such a way that one half of each sealing element 42 secures one of the rotating blades 14.

As in the prior art, a fully fitted ring of sealing elements 42 forms a sealing ring which separates a region 37 through which a coolant can flow from a further region 39 in which a hot gas can possibly appear.

In order to secure the sealing element 42 against a displacement in the circumferential direction U, said sealing element 42 comprises a sheet-metal strip 60. The sheet-metal strip 60 is preferably provided at the inner end 61 of the sealing element 42 and, in an identical manner as in the prior art, is fastened to the sealing element 42. In deviation from the prior art, however, the slots 40 necessary for this purpose and provided in the sealing element 42 extend in the radial direction. The sheet-metal strip 60 passed through these slots 40 and thus hooked to the sealing element 42 is bent at right angles and is therefore of essentially L-shaped design, provided the sheet-metal strip 60 is viewed in a plane essentially parallel to the sheet-metal-like sealing element 42. In its extent, it has a first leg 62 which extends in the circumferential direction U of the rotor 23 and with which the sheet-metal strip 60 is fastened to the sealing element 42. The second leg 64, extending inward in the radial direction, of the sheet-metal strip 60 engages in a securing pocket 66 which is provided on the side face 56 of the shaft collar 21. On account of the shape of the sheet-metal strip 60 bent at right angles and of its comparatively short second leg 64, bending-up of the displacement securing arrangement under centrifugal force can be avoided.

The securing pocket 66 is formed by two spaced-apart teeth 68 which project radially outward on the outer edge of the projection 58. Of course, the securing pocket 66 could also be formed by a recess 69, given a corresponding length of the second leg 64.

Since the side regions of the second leg 64 bear against the side walls, in each case extending in the radial direction, of the securing pocket 66 or against the teeth 68, the sealing element 42 according to the invention is reliably secured against displacement in the circumferential direction U.

Although not shown, every second sealing element or also every sealing element of the sealing ring can be secured by a sheet-metal strip 60 against a displacement along the slot 20.

Figure 4:
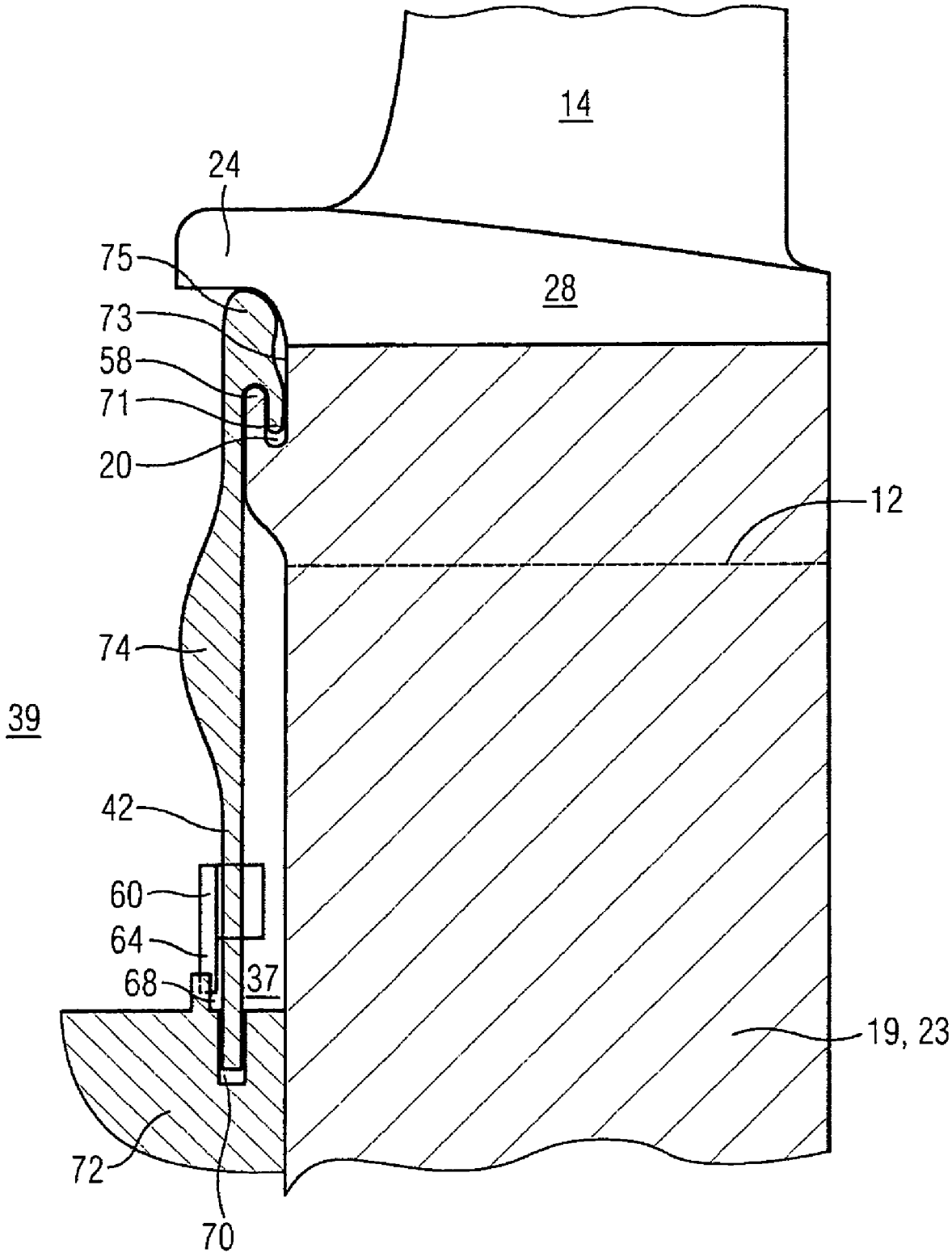
FIG. 4 shows, in an alternative configuration, a further sealing element according to the invention in cross section.

In an alternative configuration, FIG. 4 shows the slot 20, encircling at the front end, radially at the level of the rotating-blade retaining slots 12. Radially further on the inside, a further slot 70 which is open outward is provided in a region adjacent to the shaft collar 21, for example in an adjacent rotor disk 72. The sealing element 42 is inserted into the inner slot 70 and has a hook 71 on its surface facing the shaft collar, said hook 71 engaging in the outer slot 20. In the process, it bears with its outer end 75 against the root 73 and/or against the neck of the rotating blade 14 at the front end. In order to obtain an especially favorable configuration, the distance, as viewed in the radial direction, between the slot 20 and the point at which the sealing element 42 bears against the root 73 is substantially smaller than the distance of the slot 20 from the further slot 70. The force acting in the axial direction on the sealing element 42 from the displacement of the rotating blade 14 therefore acts over a short distance or lever relative to the "pivot point" in the region of the slot 20. The long distance or lever, which in addition is locally thickened in section 74 for stiffening, is provided in order to produce a sufficient counterforce in a simple manner. In this case, the sealing element 42 is secured against displacement in the circumferential direction in a manner analogous to the configuration shown in FIG. 3, the teeth for reinforcing the front-end region of the shaft collar 21 being provided on the adjacent rotor disk 72.

On the whole, a novel arrangement 10 and securing of the sealing elements is specified by the invention, in which the sheet-metal strips provided for preventing a displacement of the sealing elements in the circumferential direction are of L-like shape and are supported on the rotor disk in the region of the radially inner end of the sealing element.

The invention claimed is:

1. An arrangement for axially securing rotating blades in a rotor, comprising:

a shaft collar arranged along a rotational axis of the rotor;

a plurality of rotating-blade retaining slots arranged at an outer circumference of the shaft collar and along an axial direction of the rotor wherein the retaining slots retain rotating blades arranged in the retaining slots;

a projection arranged on a front-end side face of the shaft collar in a region of the rotating-blade retaining slots and having an encircling slot that opens radially outward;

a plurality of sheet-metal-like sealing elements that each engage the encircling slot to axially secure the rotating blades and form a front-end sealing ring in the circumferential direction;

a sheet metal strip secured to at least one of the sealing elements arranged and constructed to secure the sealing elements against a displacement in the circumferential direction, wherein the sheet-metal strip:

is of essentially L-shaped design in its extent, and a first leg extending in the circumferential direction is fastened to the sealing element and a second leg extending inward in the radial direction engages in a securing pocket provided in the region of the shaft collar.

2. The arrangement as claimed in claim 1, wherein at least every second sealing element has a further sheet-metal strip of identical construction to the sheet-metal strip that engage in further respective securing pockets arranged on the side face of the shaft collar, where the further sheet-metal strips and further securing pockets are provided and arranged for securing the sealing elements against circumferential displacement.

3. The arrangement as claimed in claim 2, wherein the side regions of the second leg of the sheet-metal strip bear against the respective side walls, extending in the radial direction, of the securing pocket.

4. The arrangement as claimed in claim 3, wherein the securing pocket formed by two spaced-apart teeth arranged on the projection.

5. The arrangement as claimed in claim 4, wherein the encircling slot is arranged radially inward relative to the rotating-blade retaining slots.

6. The arrangement as claimed in claim 5, wherein a securing slot arranged in each rotating blade is provided on an underside of a platform of the rotating blade, and the sealing element engages in said securing slot.

7. The arrangement as claimed in claim 6, wherein the shaft collar is formed by a rotor disk.

8. The arrangement as claimed in claim 4, wherein the encircling slot at the front end is arranged radially in line with the rotating-blade retaining slots, and a further slot that opens outward is arranged radially inward relative to the rotating-blade retaining slots, the sealing element engaging in both slots and bearing against the root of the rotating blade at the front end.

9. A rotor sealing element, comprising:

a sheet-metal sealing element;

a sheet-metal strip of essentially L-shaped design in its extent fastened to the sealing element that extends through two slots provided in the sealing element, wherein a first leg of the sheet-metal strip extends in the circumferential direction of the rotor is fastened to the sealing element and a second leg of the sheet-metal strip extends inward in the radial direction of the rotor.

10. The arrangement as claimed in claim 9, wherein at least every second sealing element has a further sheet-metal strip of identical construction to the sheet-metal strip that engage in further respective securing pockets arranged on the side face of the shaft collar, where the further sheet-metal strips and further securing pockets are provided and arranged for securing the sealing elements against circumferential displacement.

11. The arrangement as claimed in claim 10, wherein the side regions of the second leg of the sheet-metal strip bear against the respective side walls, extending in the radial direction, of the securing pocket.

12. The arrangement as claimed in claim 11, wherein the securing pocket formed by two spaced-apart teeth arranged on the projection.

13. An axial flow gas turbine, comprising:

a rotor arranged coaxially with a rotational axis of the turbine, the rotor having:

a plurality of rotating blades, a shaft collar arranged along a rotational axis of the rotor, a plurality of rotating-blade retaining slots arranged at an outer circumference of the shaft collar and along an axial direction of the rotor wherein the retaining slots retain rotating blades arranged in the retaining slots, a projection arranged on a front-end side face of the shaft collar in a region of the rotating-blade retaining slots and having an encircling slot that opens radially outward;

a plurality of sheet-metal-like sealing elements that each engage the encircling slot to axially secure the rotating blades and form a front-end sealing ring in the circumferential direction, a sheet metal strip secured to at least one of the sealing elements arranged and constructed to secure the sealing elements against a displacement in the circumferential direction, wherein the sheet-metal strip:

is of essentially L-shaped design in its extent, and a first leg extending in the circumferential direction is fastened to the sealing element and a second leg extending inward in the radial direction engages in a securing pocket provided in the region of the shaft collar;

a compressor section that compresses a working flow of the gas turbine;

a combustion section that receives the compressed working flow and provides a hot working flow; and a turbine section that expands the hot working flow to extract mechanical energy in the form of shaft power.

14. The gas turbine as claimed in claim 13, wherein at least every second sealing element has a further sheet-metal strip of identical construction to the sheet-metal strip that engage in further respective securing pockets arranged on the side face of the shaft collar, where the further sheet-metal strips and further securing pockets are provided and arranged for securing the sealing elements against circumferential displacement.

15. The arrangement as claimed in claim 14, wherein the side regions of the second leg of the sheet-metal strip bear against the respective side walls, extending in the radial direction, of the securing pocket.

16. The arrangement as claimed in claim 15, wherein the securing pocket formed by two spaced-apart teeth arranged on the projection.

17. The arrangement as claimed in claim 16, wherein the encircling slot is arranged radially inward relative to the rotating-blade retaining slots.

18. The arrangement as claimed in claim 17, wherein a securing slot arranged in each rotating blade is provided on an underside of a platform of the rotating blade, and the sealing element engages in said securing slot.

19. The arrangement as claimed in claim 18, wherein the shaft collar is formed by a rotor disk.

20. The arrangement as claimed in claim 16, wherein the encircling slot at the front end is arranged radially in line with the rotating-blade retaining slots, and a further slot that opens outward is arranged radially inward relative to the rotating-blade retaining slots, the sealing element engaging in both slots and bearing against the root of the rotating blade at the front end.

* * * * *